US005473521A

United States Patent [19]

Minshall

[11] Patent Number: 5,473,521

[45] Date of Patent: Dec. 5, 1995

[54] FLASHLIGHT WITH DETACHABLE BATTERY TERMINALS

[76] Inventor: Robert J. Minshall, 116 Three Rivers Dr., Newark, Del. 19702

[21] Appl. No.: 359,737

[22] Filed: Dec. 20, 1994

[51] Int. Cl.[6] ..... F21L 7/00

[52] U.S. Cl. ..... 362/205; 200/60

[58] Field of Search ..... 200/60; 362/202, 362/203, 204, 205

[56] References Cited

U.S. PATENT DOCUMENTS

| | | | |
|---|---|---|---|
| 2,677,022 | 4/1954 | Fleming | 200/60 |
| 3,261,972 | 7/1966 | Stahl | 362/205 |
| 4,130,859 | 12/1978 | Battarel | 362/205 |

*Primary Examiner*—Stephen F. Husar

[57] ABSTRACT

A flashlight with detachable battery terminals comprising a hollow housing having an open end; a light source disposed within the housing for providing illumination; a battery removably disposed within the housing for providing electrical energy with the battery having a first pole and a second pole; an elongated slidable electrically conductive arm coupled to the housing and light source and having a first battery terminal formed on one end and a pivotable second battery terminal formed on the other end with the first battery terminal positioned against the first pole and the second battery terminal positioned against the second pole and light source when the arm is slid in one direction to thereby define an engaged mode of operation and with the first battery terminal positioned away from the first pole and the second battery terminal positioned away from the second pole and light source when the arm in slid in another direction to thereby define a disengaged mode of operation; and a power switch coupled to the arm and housing for placing the arm in the engaged and the disengaged modes of operation.

5 Claims, 4 Drawing Sheets

FLASHLIGHT WITH DETACHABLE BATTERY TERMINALS

BACKGROUND OF THE INVENTION

1. Field of the Invention

The present invention relates to a flashlight with detachable battery terminals and more particularly pertains to providing illumination in an engaged mode of operation and allowing electrical disengagement of its battery terminals from its batteries in a disengaged mode of operation and thereby extending the operational life of such batteries with a flashlight with detachable battery terminals.

2. Description of the Prior Art

The use of flashlights is known in the prior art. More specifically, flashlights heretofore devised and utilized for the purpose of providing illumination are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,851,126 to Keller discloses a flashlight switch. U.S. Pat. No. 3,992,596 to Miller discloses a flashlight switch having removably mounted contact terminal securing structure. U.S. Pat. No. 4,797,517 to Ohashi discloses a switch device of portable flashlight. U.S. Pat. No. 4,905,129 to Sharrah discloses a flashlight with tail cap switch. U.S. Pat. No. 4,939,628 to Wang discloses a switch mechanism for a flashlight.

While these devices fulfill their respective, particular objective and requirements, the aforementioned patents do not describe a flashlight with detachable battery terminals that allows the electrical circuit for providing illumination to be completely disconnected from a power source within the flashlight, thereby preventing inadvertent leakage of electrical energy from the power source and thus lengthening its operational life.

In this respect, the flashlight with detachable battery terminals according to the present invention substantially departs from the conventional concepts and designs of the prior art, and in doing so provides an apparatus primarily developed for the purpose of providing illumination in an engaged mode of operation and allowing electrical disengagement of its battery terminals from its batteries in a disengaged mode of operation and thereby extending the operational life of such batteries.

Therefore, it can be appreciated that there exists a continuing need for new and improved flashlight with detachable battery terminals which can be used for providing illumination in an engaged mode of operation and allowing electrical disengagement of its battery terminals from its batteries in a disengaged mode of operation and thereby extending the operational life of such batteries. In this regard, the present invention substantially fulfills this need.

SUMMARY OF THE INVENTION

In the view of the foregoing disadvantages inherent in the known types of flashlights now present in the prior art, the present invention provides an improved flashlight with detachable battery terminals. As such, the general purpose of the present invention, which will be described subsequently in greater detail, is to provide a new and improved flashlight with detachable battery terminals and method which has all the advantages of the prior art and none of the disadvantages.

To attain this, the present invention essentially comprises, in combination, an elongated rigid housing having an openable base end, an open tip end, an intermediate location therebetween, a tubular hollow intermediate portion extended from the base end to the intermediate location, and an generally conical hollow head extended outwardly from the intermediate location to the tip end. The intermediate portion of the housing further includes two elongated battery compartments formed therein and aligned in an end-to-end configuration. A light source is included and disposed within the head of the housing. The light source has an electrically conductive terminal portion and a bulb projected outwards therefrom and facing the tip end of the housing with the bulb providing illumination when electrically energized through the terminal portion. An electrically conductive parabolic reflector is included and coupled between the terminal portion of the light source and head of the housing for directing illumination from the bulb toward the tip end. A transparent circular planar lens is included and coupled across the tip end for shielding the light source and reflector. Two batteries are included for providing electrical energy with each battery disposed within a separate battery compartment and in contact with each other such that they form a power source having a positive pole facing the tip end of the housing and a negative pole facing the base end of the housing. An elongated rigid arm is included and coupled within housing at a location adjacent to the power source for longitudinal slidable movement with respect thereto. The arm is formed of an electrically conductive rod having two ends. A bottom contact is formed on one end of the rod and serves as a first battery terminal. The bottom contact faces the negative pole of the power source. A top contact is formed on the other end of the rod. The top contact is slidably abutted against the parabolic reflector. The arm includes an insulated connector coupled to and extended outwards between the bottom end and top end of the rod. The insulated connector includes a pivotable rocker lever coupled thereto at a location between the positive pole of the power source and the terminal portion of the light source. The rocker lever serves as a second battery terminal. The first battery terminal is positioned against the negative pole and the second battery terminal is positioned in contact against the positive pole and the terminal portion of the light source when the arm is slid towards the tip end of the housing to thereby define an engaged mode of operation. The first terminal is positioned away from the negative pole and the second terminal is positioned away from the positive pole and terminal portion of the light source when the arm is slid towards the base end of the housing to thereby define a disengaged mode of operation. Lastly, a power switch is included and coupled to the arm and extended through the intermediate portion of the housing. The power switch has one orientation for placing the arm in an engaged mode of operation for energizing the light source and another orientation for placing the arm in the disengaged mode of operation for de-energizing the light source.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flashlight with detachable battery terminals which has all the advantages of the prior art flashlights and none of the disadvantages.

It is another object of the present invention to provide a new and improved flashlight with detachable battery terminals which may be easily and efficiently manufactured and marketed.

It is a further object of the present invention to provide a new and improved flashlight with detachable battery terminals which is of durable and reliable construction.

An even further object of the present invention is to provide a new and improved flashlight with detachable battery terminals which is susceptible of a low cost of manufacture with regard to both materials and labor, and which accordingly is then susceptible of low prices of sale to the consuming public, thereby making such a flashlight with detachable battery terminals economically available to the buying public.

Still yet another object of the present invention is to provide a new and improved flashlight with detachable battery terminals which provides in the apparatuses and methods of the prior art some of the advantages thereof, while simultaneously overcoming some of the disadvantages normally associated therewith.

Even still another object of the present invention is to provide a new and improved flashlight with detachable battery terminals for providing illumination in an engaged mode of operation and allowing electrical disengagement of its battery terminals from its batteries in a disengaged mode of operation and thereby extending the operational life of such batteries.

Lastly, it is an object of the present invention to provide a new and improved flashlight with detachable battery terminals comprising a hollow elongated rigid housing having an open end; a light source disposed within the housing facing the open end for providing illumination when electrically energized; a battery removably disposed with the housing for providing electrical energy with the battery having a first pole and a second pole; an elongated longitudinally slidable electrically conductive arm coupled to the housing and light source and having a first battery terminal formed on one end and a pivotable second battery terminal formed on the other end with the first battery terminal positioned against the first pole and the second battery terminal positioned against the second pole and light source when the arm is slid in one direction to thereby define an engaged mode of operation and with the first battery terminal positioned away from the first pole and the second battery terminal positioned away from the second pole and light source when the arm in slid in another direction to thereby define a disengaged mode of operation; and a power switch coupled to the arm and housing for placing the arm in an engaged mode of operation for energizing the light source and for placing the arm in the disengaged mode of operation for de-energizing the light source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
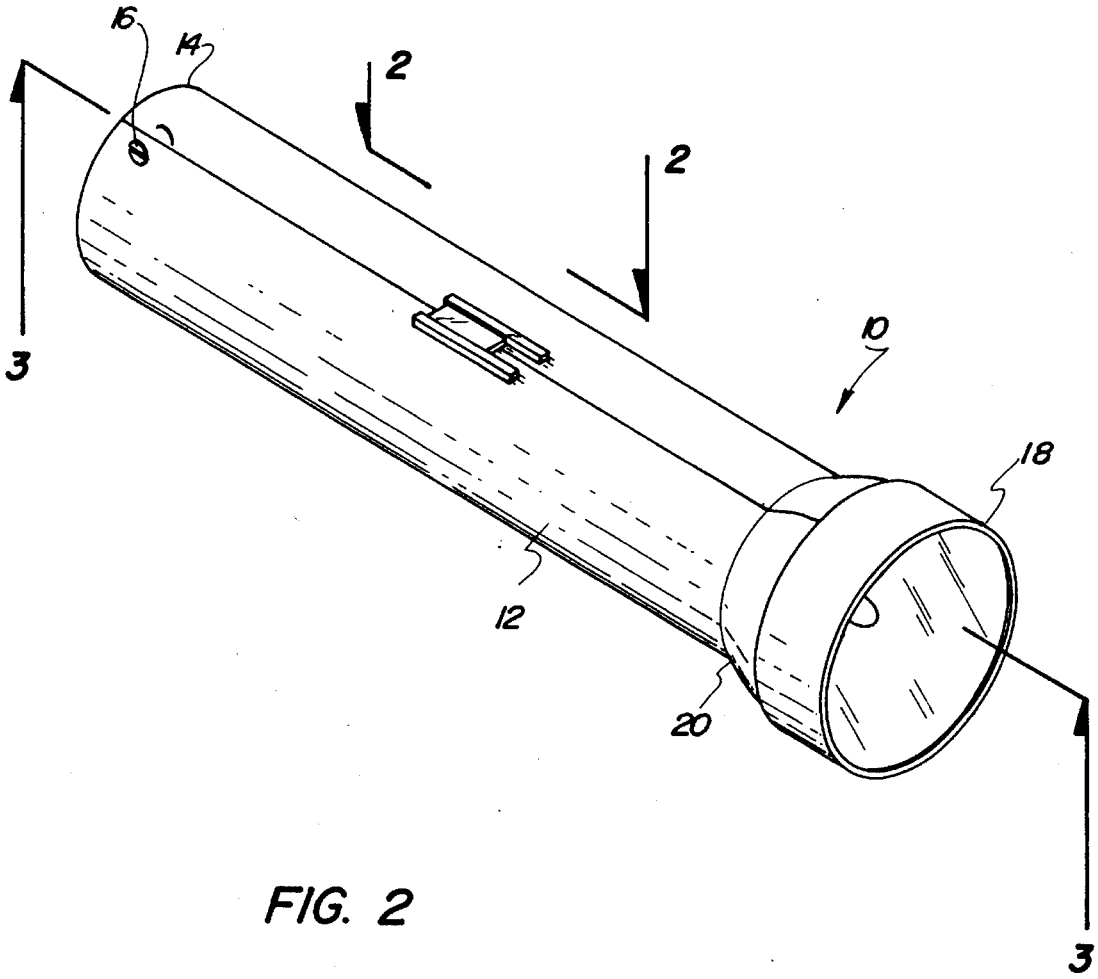
FIG. 1 is a perspective view of the preferred embodiment of the flashlight with detachable battery terminals constructed in accordance with the principles of the present invention.
Figure 2:
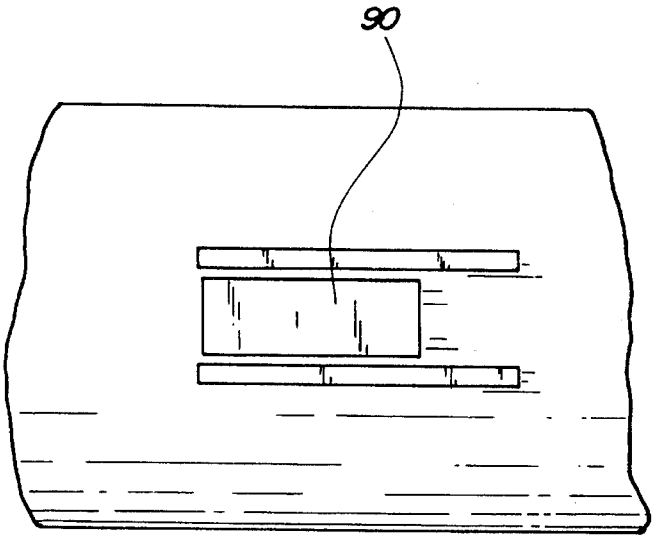
FIG. 2 is a top view of the power switch taken along the line 2—2 of FIG. 1.
Figure 3:
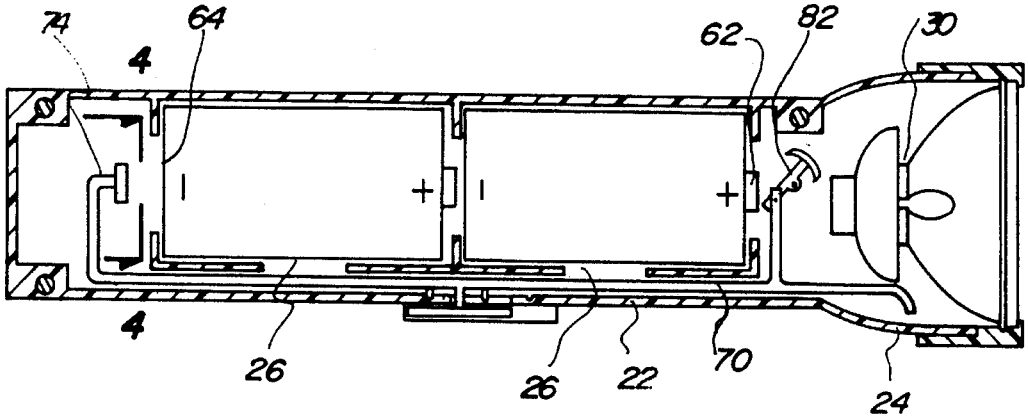
FIG. 3 is a cross-sectional view of the present invention in a disengaged mode of operation taken along line 3—3 of FIG. 1.
Figure 4:
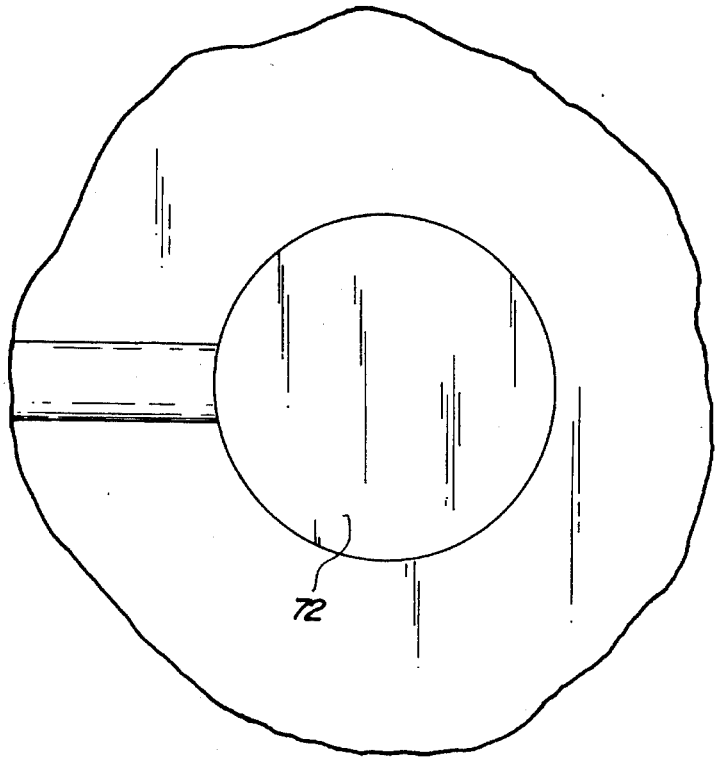
FIG. 4 is a view of the bottom contact taken along the line 4—4 of FIG. 3.
Figure 5:
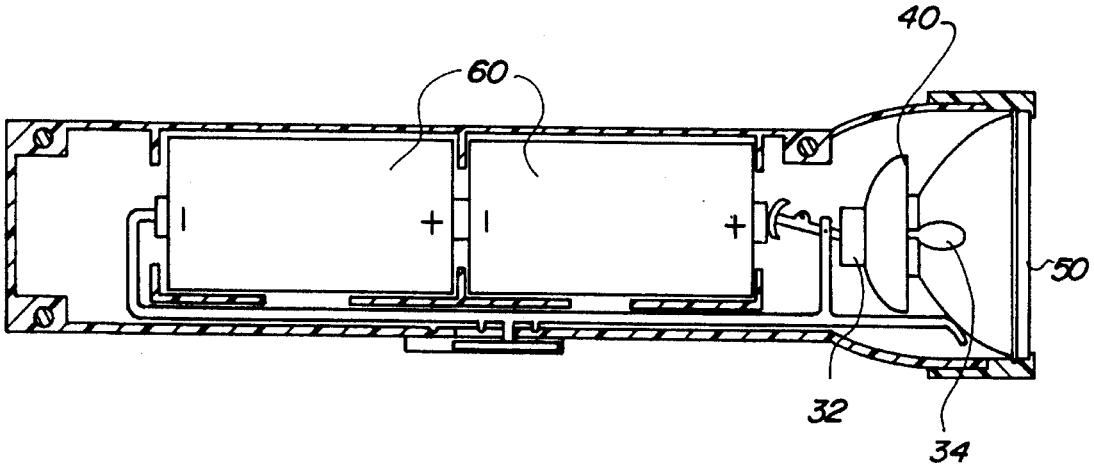
FIG. 5 is yet another cross-sectional view of the present invention in a disengaged mode of operation.
Figure 6:
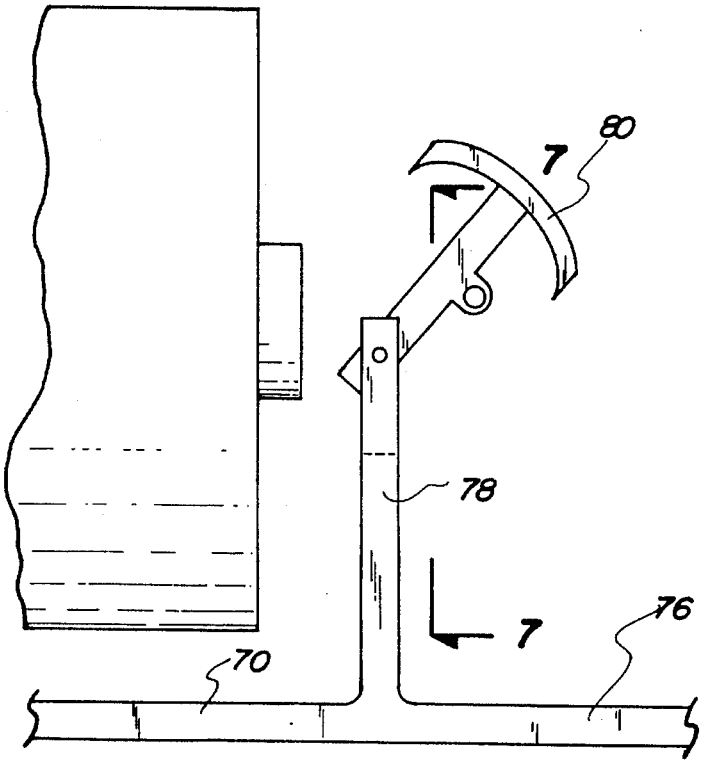
FIG. 6 is an enlarged view of the association of the rocker lever with the positive pole of the power source.
Figure 8:
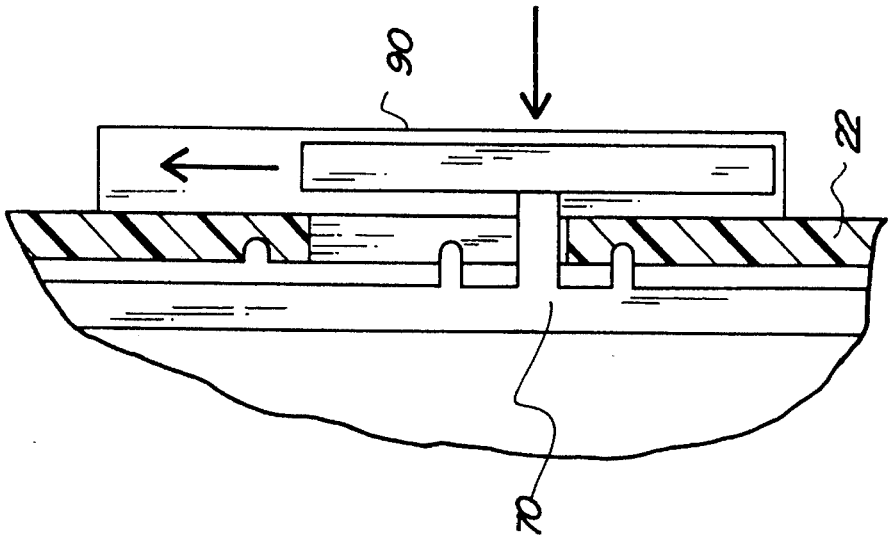
FIG. 8 is an enlarged cross-sectional view depicting the actuation required for placing the switch in an engaged mode of operation.
Figure 7:
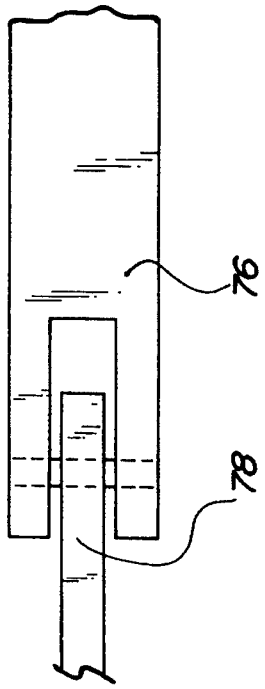
FIG. 7 is a view of the coupling of the rocker lever with the connector of the arm taken along the line 7—7 of FIG. 6.

With reference now to the drawings, and in particular, to FIG. 1 thereof, the preferred embodiment of the new and improved flashlight with detachable battery terminals embodying the principles and concepts of the present invention and generally designated by the reference number 10 will be described.

The present invention is comprised of a plurality of components. In their broadest context, such components include a housing, light source, reflector, lens and batteries. Such components are individually configured and correlated with respect to each other to provide the intended function.

Specifically, the flashlight with detachable battery terminals includes a housing 12. The housing is elongated in structure. It is formed of a rigid material such as metal or plastic. The housing has an openable base end 14. This base end is formed of a cap secured with screws 16. The housing has an open tip end 18 axially aligned with and remote from the base end. An intermediate location 20 is defined between the base end and tip end. The housing includes a tubular hollow elongated intermediate portion 22 extended from the base end to the intermediate location. A generally conical hollow head 24 is extended outwardly from the intermediate location to the tip end. The intermediate location further includes a plurality of dividing walls coupled therein to thereby define two elongated battery compartments 26. The battery compartments are aligned in an end-to-end configuration with each adapted for holding a replaceable battery therein.

A light source 30 is disposed within the head of the housing. The light source has an electrically conductive terminal portion 32 with a socket formed therein and a replaceable bulb 34 coupled within the socket and projected outwards therefrom such that it faces the tip end of the housing. The bulb is conventional in design and provides illumination when electrically energized through the terminal portion.

To direct light outwards from the housing, a parabolic reflector 40 is utilized. The reflector is coupled between the terminal portion of the light source 30 and the head 24 of the housing. The reflector is positioned such that it directs light from the bulb towards the tip end of the housing. The reflector is formed of a rigid reflective and electrically conductive material such as metal.

To shield the light source and reflector from access, a lens 50 is coupled across the tip end of the housing. The lens is circular and planar in structure. It is formed of a transparent material such as glass or plastic. The lens may also be colored for providing a desired illumination characteristic.

Batteries 60 are also disposed within the battery compartments 26 for providing electrical energy. In the preferred embodiment, two batteries are utilized. The batteries are positioned within the compartments such that they are in contact with each other and form a power source having a positive pole 62 facing the tip end of the housing and a negative pole 64 facing the base end of the housing. Each battery is conventional in design and commercially available. The batteries may be replaced through the openable base end 14 or through an access door provided on the intermediate portion of the housing.

Electrical power is transferred from the power source to the light source through the use of a arm 70. The arm is elongated and rigid in structure. The arm is coupled within the housing at a location adjacent to the power source. The arm is longitudinally slidable with respect to the housing and power source. The arm includes an electrically conductive rod having two ends. On one end of the rod, a disc-shaped bottom contact 72 serves as a first battery terminal 74. This first battery terminal is positioned such that it faces the negative pole of the power source. At the other end of the rod, a top contact 76 is slidably abutted against the parabolic reflector. An insulated plastic connector 78 is coupled between the ends of the rod and extended outwards therefrom. The connector includes a pivotable electrically conductive metal rocker lever 80 coupled thereto. This rocker lever is positioned between the positive pole of the power source and the terminal portion of the light source. The rocker lever serves as a second battery terminal 82. The first battery terminal is positioned against the negative pole 64 of the power source and the second battery terminal is positioned in contact against and between the positive pole 62 of the power source and the terminal portion of the light source when the arm is slid toward the tip end 18 of the housing. When positioned in such manner, an engaged mode of operation is defined, and an electrical circuit is completed between the battery, arm, reflector and light source for energizing the light source. The first terminal is also positioned away from the negative pole of the power source and the second terminal is also positioned away from the positive pole of the power source and terminal portion when the arm is slid towards the base end 14 of the housing. In this position, a disengaged mode of operation is defined, thereby breaking the electric circuit between the battery, arm, reflector and light source for de-energizing the light source.

A power switch 90 is coupled to the arm and extended through the intermediate portion 22 of the housing. The power switch has one orientation for placing the arm in an engaged mode of operation for energizing the light source. The power switch has another orientation for placing the arm in the disengaged mode of operation for de-energizing the light source. The power switch locks into place when slidably positioned into the orientation that actuates the engaged mode of operation. The power switch is released from this locked position by pressing downwards and then sliding in an opposite direction.

The present invention is designed to obtain longer life from its batteries. While batteries are advertised to provide years of service, that performance is never achieved. That deficiency is probably attributable to electrical leakage that occurs in prior art flashlights even when the power switches of these flashlights are placed in a disengaged position. This is because the switching circuitry of prior art flashlights forms a closed-loop circuit through the batteries, and this circuitry totally relies on the power switch to break the circuit. Apparently, however, sufficient leakage occurs with this arrangement to seriously reduce the useful life of the batteries. This is very wasteful and inefficient, but fortunately, it can be prevented by the unique switching design provided by the present invention.

Rather than having positive closed-loop connections to the batteries as in prior art flashlights, the present invention totally disengages the power source from the light source. This disengagement eliminates all possibility of leakage. When the switch in the present invention is turned on, the arm completes an electrical circuit between the power source and light source. This switching design can also be incorporated in other self-contained battery operated flashlights.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A flashlight with detachable battery terminals for providing illumination in an engaged mode of operation and allowing electrical disengagement of its terminals from its batteries in a disengaged mode of operation and thereby extending the operational life of such batteries comprising, in combination:

an elongated rigid housing having an openable base end, an open tip end, an intermediate location therebetween, a tubular hollow intermediate portion extended from the base end to the intermediate location, and an generally conical hollow head extended outwardly from the intermediate location to the tip end and with the intermediate portion further having two elongated battery compartments formed therein and aligned in an end-to-end configuration;

a light source disposed within the head of the housing, the light source having an electrically conductive terminal portion and a bulb projected outwards therefrom and facing the tip end of the housing with the bulb providing illumination when electrically energized through the terminal portion;

an electrically conductive parabolic reflector coupled between the terminal portion of the light source and the head of the housing for directing illumination from the bulb toward the tip end;

a transparent circular planar lens coupled across the tip end for shielding the light source and reflector;

two batteries for providing electrical energy with each battery disposed within a separate battery compartment and in contact with each other such that they form a power source having a positive pole facing the tip end of the housing and a negative pole facing the base end of the housing;

an elongated rigid arm coupled within housing at a location adjacent to the power source for longitudinal slidable movement with respect thereto, the arm including an electrically conductive rod having one end with a bottom contact facing the negative pole of the power source and serving as a first battery terminal and another end slidably abutted against the parabolic reflector, the arm further including an insulated connector extended outwards between the ends of the rod and having a pivotable electrically conductive rocker lever coupled thereto at a location between the positive pole of the power source and the terminal portion of the light source and serving a second battery terminal with the first battery terminal positioned against the negative pole and the second battery terminal positioned in contact against the positive pole and the terminal portion when the arm is slid towards the tip end of the housing to thereby define an engaged mode of operation that completes a circuit for energizing the light source and with the first terminal positioned away from the negative pole and the second terminal positioned away from the positive pole and terminal portion when the arm is slid towards the base end of the housing to thereby define a disengaged mode of operation that breaks the circuit for de-energizing the light source; and a power switch coupled to the arm and extended through the intermediate portion of the housing with the power switch having one orientation for placing the arm in an engaged mode of operation for energizing the light source and with the power switch having another orientation for placing the arm in the disengaged mode of operation for de-energizing the light source.

2. A flashlight with detachable battery terminals comprising:

a hollow elongated rigid housing having an open end;

a light source disposed within the housing facing the open end for providing illumination when electrically energized;

a battery removably disposed with the housing for providing electrical energy, the battery having a first pole and a second pole;

an elongated longitudinally slidable electrically conductive arm coupled to the housing and light source and having a first battery terminal formed on one end and a pivotable second battery terminal formed on the other end with the first battery terminal positioned against the first pole and the second battery terminal positioned against the second pole and light source when the arm is slid in one direction to thereby define an engaged mode of operation that completes a circuit for energizing the light source and with the first battery terminal positioned away from the first pole and the second battery terminal positioned away from the second pole and light source when the arm in slid in another direction to thereby define a disengaged mode of operation that breaks the circuit for de-energizing the light source; and a power switch coupled to the arm and housing for placing the arm in an engaged mode of operation for energizing the light source and for placing the arm in the disengaged mode of operation for de-energizing the light source.

3. The flashlight with detachable battery terminals as set forth in claim 2 further including a parabolic reflector disposed about the light source for directing illumination toward the open end.

4. The flashlight with detachable battery terminals as set forth in claim 2 further including a generally transparent lens coupled across the open end.

5. A power switch apparatus with detachable battery terminals for use with a flashlight comprising:

an elongated longitudinally slidable electrically conductive arm coupleable to a housing and a light source of a flashlight, the arm having a first battery terminal and a pivotable second battery terminal with the first battery terminal positionable against a pole of a battery of said flashlight and the second battery terminal positionable against a separate pole of said battery and a light source of said flashlight when the arm is slid in one direction to thereby define an engaged mode of operation and with the first battery terminal positionable away from said pole and the second battery terminal positionable away from said other pole and said light source when the arm in slid in another direction to thereby define a disengaged mode of operation; and a power switch coupled to the arm and coupleable to said housing of said flashlight for placing the arm in an engaged mode of operation and the disengaged mode of operation.

* * * * *